US009765435B2

(12) United States Patent
Zahiri et al.

(10) Patent No.: US 9,765,435 B2
(45) Date of Patent: Sep. 19, 2017

(54) PROCESS FOR PRODUCING A TITANIUM LOAD-BEARING STRUCTURE

(71) Applicant: COMMONWEALTH SCIENTIFIC AND INDUSTRIAL RESEARCH ORGANISATION, Campbell, Australian Capital Territory (AU)

(72) Inventors: Saden Zahiri, Clayton (AU); Mahnaz Jahedi, Clayton (AU); Jeffrey Lang, Dandenong (AU); Timothy Fox, Dandenong (AU); Richard Fox, Dandenong (AU)

(73) Assignee: Commonwealth Scientific and Industrial Research Organisation (AU)

( * ) Notice: Subject to any disclaimer, the term of this patent is extended or adjusted under 35 U.S.C. 154(b) by 148 days.

(21) Appl. No.: 14/390,545

(22) PCT Filed: Mar. 26, 2013

(86) PCT No.: PCT/AU2013/000318
§ 371 (c)(1),
(2) Date: Oct. 3, 2014

(87) PCT Pub. No.: WO2013/149291
PCT Pub. Date: Oct. 10, 2013

(65) Prior Publication Data

US 2015/0056465 A1 Feb. 26, 2015

(30) Foreign Application Priority Data

Apr. 4, 2012 (AU) ..... 2012901345

(51) Int. Cl.
*C23C 24/04* (2006.01)
*C23C 30/00* (2006.01)
(Continued)

(52) U.S. Cl.
CPC ..... *C23C 24/04* (2013.01); *B05B 7/1486* (2013.01); *B05B 7/1613* (2013.01); *B22F 3/02* (2013.01);
(Continued)

(58) Field of Classification Search
None
See application file for complete search history.

(56) References Cited

U.S. PATENT DOCUMENTS 4,942,778 A 7/1990 Bryne
5,122,210 A * 6/1992 Kubomura ..... B29C 44/1228 156/245
(Continued)

FOREIGN PATENT DOCUMENTS

CN 101983258 A 3/2011
EP 2261027 A2 12/2010
(Continued)

OTHER PUBLICATIONS

In correspondence with the Chinese Office Action from the Chinese Patent application No. 2013800292198, dated Mar. 2, 2016, 6 pages.
(Continued)

*Primary Examiner* — Michael Wieczorek
*Assistant Examiner* — Bradford Gates
(74) *Attorney, Agent, or Firm* — Tarolli, Sundheim, Covell & Tummino LLP

(57) ABSTRACT

A process for producing a titanium load-bearing structure, which comprises cold-gas dynamic spraying of titanium particles on to a suitably shaped support member, and a titanium load bearing structure so-produced.

15 Claims, 2 Drawing Sheets

(51) Int. Cl.

| | |
|---|---|
| ***B05B 7/14*** | (2006.01) |
| ***B05B 7/16*** | (2006.01) |
| ***B22F 3/02*** | (2006.01) |

(52) U.S. Cl.
CPC ..... *C23C 30/00* (2013.01); *B22F 2301/205* (2013.01); *Y10T 428/12063* (2015.01)

(56) References Cited

U.S. PATENT DOCUMENTS

| | | | | |
|---|---|---|---|---|
| 5,302,414 | A | 4/1994 | Alkhimov et al. | |
| 7,910,051 | B2 * | 3/2011 | Zimmermann | B22F 7/08 204/298.12 |
| 2004/0134645 | A1 * | 7/2004 | Higashiyama | F28F 9/026 165/153 |
| 2006/0045785 | A1 | 3/2006 | Hu et al. | |
| 2006/0093736 | A1 * | 5/2006 | Raybould | C23C 24/04 427/180 |
| 2009/0075112 | A1 * | 3/2009 | Kulkarni | C23C 4/06 428/639 |
| 2009/0152042 | A1 * | 6/2009 | Pierick | B62K 3/04 180/311 |
| 2011/0223053 | A1 * | 9/2011 | Jahedi | B21C 37/06 419/66 |
| 2011/0312860 | A1 * | 12/2011 | Mathew | C23C 4/04 508/103 |
| 2011/0314791 | A1 * | 12/2011 | Haynes | C23C 24/04 60/253 |

FOREIGN PATENT DOCUMENTS

| | | | |
|---|---|---|---|
| FR | 2899869 | A1 | 10/2007 |
| JP | 2003200874 | | 7/2003 |
| JP | 2005104287 | | 4/2005 |
| JP | 2011513589 | | 4/2011 |
| WO | 2006050329 | | 5/2006 |
| WO | 2011083321 | | 7/2011 |

OTHER PUBLICATIONS

Office Action for corresponding JP Patent Appl. No. 2015-503714, dated Jan. 18, 2017 pp. 1-3.

* cited by examiner

PROCESS FOR PRODUCING A TITANIUM LOAD-BEARING STRUCTURE

TECHNICAL FIELD OF INVENTION

The present invention relates to the production of structures from titanium and titanium alloys. The present invention also relates to structures produced in accordance with the present invention.

BACKGROUND TO INVENTION

Titanium and titanium alloys have high strength to weight ratio, high stiffness and excellent corrosion resistance. For these reasons it is desirable to use such materials to produce load-bearing structures, such as bicycle frames. Current manufacturing methods for producing titanium/titanium alloy load bearing structures, such as bicycle frames, typically involve forming individual tubular frame components (by vacuum casting and deformation processes to produce the desired component profile) followed by assembly and welding of the various components to produce the frame. As titanium/titanium alloys have a high affinity for oxygen, high temperature processing such as welding must take place in a protective (reducing) atmosphere. Overall, this conventional approach is time-consuming, energy and labour intensive, and thus costly. As a result the use of titanium/titanium alloys has been somewhat limited to such things as aerospace, biomedical and high end sports products. The constraints associated with conventional manufacturing methodologies are impeding more widespread use of titanium and titanium alloys.

Against this background it would be desirable to offer a process for the manufacture of titanium/titanium alloy load-bearing structures that does not suffer these problems.

SUMMARY OF INVENTION

Accordingly, the present invention provides a process for producing a titanium load-bearing structure, which comprises cold-gas dynamic spraying of titanium particles on to a suitably shaped support member.

The present invention also provides a titanium load-bearing structure produced in accordance with the present invention.

In this specification, unless otherwise indicated, the term "titanium" is used denote titanium per se and titanium alloys. Thus, the process of the present invention may be applied to produce titanium load-bearing structures and titanium alloy load-bearing structures.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

BRIEF DISCUSSION OF DRAWING

Embodiments of the present invention are illustrated with reference to the accompanying non-limiting drawing in which.

DETAILED DISCUSSION

Figure 1:
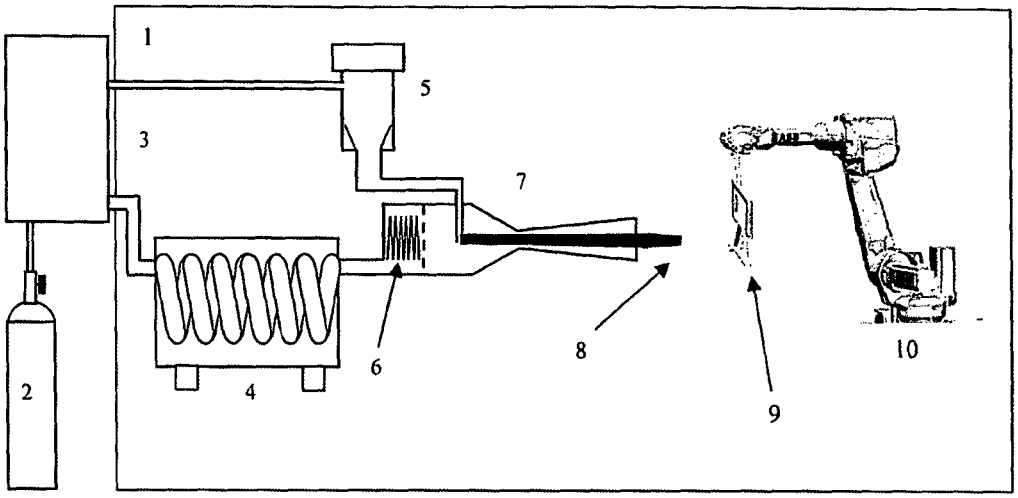
FIG. 1 is a schematic diagram showing a cold spray system for deposition of titanium on a bicycle frame scaffold.

The use of cold spray in accordance with the present invention enables titanium particles to be deposited in the solid state and at extremely high speed on to a suitable support member (also referred to herein as a "scaffold"). Advantageously, this eliminates many intermediate high temperature manufacturing process steps that might otherwise be required, such as melting, rolling and welding of titanium. Such steps typically require a controlled atmosphere to prevent titanium oxidation. The elimination of such process steps may also be beneficial in terms of energy consumption and carbon emissions.

The use of cold spray in accordance with the present invention may also lead to a reduction in materials input, elimination of mould and melting cost and/or reduction of reworking and finishing for titanium products. Accordingly, the use of cold spray in accordance with the present invention may decrease manufacturing costs and enhance manufacturing efficiency and rate, with corresponding commercial benefits.

Cold-gas dynamic spraying (cold spraying) is a known process that has been used for applying coatings to surfaces. In general terms, the process involves feeding (metallic and/or non-metallic) particles into a high pressure gas flow stream which is then passed through a converging/diverging nozzle that causes the gas stream to be accelerated to supersonic velocities (normally above 1000 m/s), or feeding particles into a supersonic gas stream after the nozzle throat. The particles are then directed to a surface to be deposited.

The process is carried out at relatively low temperatures, below the melting point of the substrate and the particles to be deposited, with a coating being formed as a result of particle impingement on the substrate surface. The fact that the process takes place at relatively low temperature allows thermodynamic, thermal and/or chemical effects, on the surface being coated and the particles making up the coating, to be reduced or avoided.

This means that the original structure and properties of the particles can be preserved without phase transformations etc. that might otherwise be associated with high temperature coating processes such as plasma, HVOF, arc, gas-flame spraying or other thermal spraying processes. The underlying principles, apparatus and methodology of cold spraying are described, for example, in U.S. Pat. No. 5,302,414.

The use of cold spraying in the context of the present invention allows the production of titanium load-bearing structures to be greatly simplified and made more economic. In the process of the present invention, cold-gas dynamic spraying is used to deposit and build up a layer of titanium on a shaped support member. This approach avoids the need to make and join together individual components in order to yield a final structure. In particular, in accordance with the present invention cold spray avoids the need to weld titanium components together. The process of the invention may be regarded as a process for producing a load-bearing structure that would otherwise (i.e. conventionally) have been produced by welding together of individual structure components. Put another way, the load-bearing structure produced in accordance with the invention is formed as a unitary construction as opposed to having been assembled by making and joining together various components.

The process of the invention is used to produce a load-bearing structure and in doing so seeks to leverage off the desirable material properties of titanium noted above. The term "load-bearing structure" is used to denote a structure the function of which is to bear a load. The load-bearing structure may take the form of a frame that is a basic structure on to which other components are fitted. By way of example, the frame may be for an aerospace or nautical vessel or motor vehicle, or it may be a frame for a bicycle, motorcycle, motor scooter, wheelchair, hang glider or luggage. The present invention is believed to be particularly well suited to making bicycle and motorcycle frames.

The load-bearing structure may be of monocoque design in which the (titanium) surface of the structure itself provides load-bearing functionality. By way of example, in this case, the load-bearing structure may be motorcycle or motor scooter fairing.

The load-bearing structure may be a final product or it may be a component of a final product. For example, in the case of a bicycle, the invention may be applied to produce the main frame. The load bearing structure may also be flat or shaped, and for example, used in building construction In the process of the present invention, cold spraying is used to deposit and build-up a layer of titanium on the surface of a support member. The shape and configuration of the support member will reflect the intended shape of the load-bearing structure to be produced. In this respect the support member may be regarded as a scaffold or skeleton.

The material used for the support member must be one that is not deformed when titanium is cold sprayed on to it. After all, the support member provides a foundation upon which titanium is deposited and any deformation of it may lead to defects and/or departure in manufacturing tolerances in the structure being produced. The mechanical properties, cost and/or the ease with which the support member can itself be produced may influence material selection for the support member. The support member may be made up of individual components that are joined together or it may be a unitary structure, for example a moulded structure.

In embodiments of the invention, after cold spraying has been completed and a sufficient thickness of titanium deposited on it (based on the intended use of the load-bearing structure), the support member is removed to produce a free-standing titanium load-bearing structure.

Removal of the support member may be important when it is desired to keep the weight of the structure down as far as possible. Depending upon complexity of design and access to it, the support member may be removed by a variety of methods. For example, the support member may be removed by mechanical means. This may involve breaking or machining away of the support member. In the case of breaking the support member, the support member may be formed of a material (such as a ceramic) that is suitably rigid and temperature resistant to allow formation of the load-bearing structure on a surface of the support member, but that is suitably fragile to allow the support member to be broken and removed when separation of the support member and structure is required.

Separation of the titanium and support member may also be achieved by relying on differences in thermal expansion coefficients between the titanium and support member. In this case, separation of the structure from the support member may be achieved by heating or cooling the titanium structure and the support member.

In this embodiment the thickness of the titanium structure formed by cold spraying must be adequate to satisfy structural requirements in those regions where the support member has been removed. Thus, the thickness of the titanium will be application driven. By way of example, for a bicycle frame, the titanium thickness may range from 1-5 mm.

As a further alternative, the support member may be removed by being dissolved or melted. For example, if the support material is aluminium this can be removed by dissolution in sodium hydroxide. Of course, whatever the approach used for removing the support member, this should not adversely impact on the titanium structure that has been produced.

In an alternative embodiment the support member is not removed after cold spraying has been completed. In this case, the support member may contribute desirable properties to the load-bearing structure that has been produced and in this case the load-bearing structure/support member should be regarded as a composite (or hybrid) structure.

In a slight variation of this embodiment it may be desired to retain the support member at specific locations and remove the support member from other locations within the structure that has been produced. For example, it may be desired to retain the support member in regions of the structure that in use will experience high load and remove the support member from lower load regions. In this way it is possible to tailor the properties of the load-bearing structure even further, whilst keeping weight down.

This embodiment also raises further design possibilities. For example, the material of the support member may be chosen based on properties that the support member will contribute to the load-bearing structure. Additionally, or alternatively, regions of the support member may vary in thickness and/or design based on the position those regions will occupy in the load-bearing structure that is produced. Additionally, or alternatively, regions of the support member may be made of different materials based on the position those regions will occupy in the load-bearing structure that is produced. It will be appreciated from this that the process of the invention provides significant design and outcome flexibility. In particular, more complex shapes of the titanium structure may be produced than with current technologies.

The surface of the support member to be coated with particles will influence the characteristics of the corresponding surface of the structure that is produced. Preferably, the surface of the support member to be coated is smooth and defect-free.

Another possible advantage of the present invention is that the composition that is applied by cold spraying may be varied as cold spraying proceeds, and this may provide flexibility in terms of product characteristics. For example, it may be desirable to vary the grade of titanium (or type of titanium alloy) used in order to meet location specific load-bearing requirements in the structure being produced. Regions that are less load-sensitive may be formed of lower quality (or lower grade) and thus cheaper materials.

In another embodiment the thickness of the titanium deposited may be varied in order to meet location specific requirements of the structure being produced. For example, regions of the structure expected to experience high loads may be made thicker than regions likely to encounter lower loads. Of course, if the structure is to be produced using multiple materials, then the compatibility of the different materials must be considered. Should two or more of the proposed materials be incompatible in some way (e.g., coherence/bonding), it may be necessary to separate the incompatible materials by one or more regions of mutually compatible material(s).

It will be appreciated that these embodiments relating to the titanium to be deposited may be applicable whether or not the support member is removed after cold spraying.

The average size of the titanium particles that are cold sprayed is likely to influence the density of the resultant deposition on the support member. Preferably the deposition is dense and free from defects, connected micro-voids (leakage) and the like, since the presence of such can be detrimental to quality. Typically, the size of the particles applied by cold spraying is from 5 to 40 microns with an average particle size of about 25 microns. One skilled in the art will be able to determine the optimum particle size or particle size distribution to use based on the morphology of the powder and characteristics of the structure that is to be formed. Generally, the thickness of the titanium layer will be developed gradually during the cold spray process.

Particles suitable for use in the present invention are commercially available. Useful grades of titanium include commercial purity titanium, especially grade 2 and 3. Useful titanium alloys are commercially available and include titanium aluminium vanadium alloys such as Titanium 64 (6% aluminium 4% vanadium).

The cold spray apparatus used for implementation of the method of the present invention is likely to be of conventional form and such equipment is commercially available or individually built. In general terms, the basis of the equipment used for cold spraying will be as described and illustrated in U.S. Pat. No. 5,302,414. Such cold spraying apparatus may be combined with equipment for holding and manipulating the support member, as required. Multiple nozzles may be used in tandem for cold spraying.

After cold spraying has been completed, the structure that has been produced may be given a surface finish, for example it may be ground, machined or polished according to the end user specifications. It is possible that other components or parts will be secured to the structure, such as brackets and the like, and this may be done in conventional manner. That said, it is possible that cold spray may be used to form brackets and the like as an integral part of the structure.

The present invention may have particular utility for producing bicycle or motorcycle frames. The invention may be applied to manufacture a frame directly from titanium powder by deposition of titanium particles onto an appropriately shaped support member. Utilising cold spray technology in accordance with the present invention, titanium particles at velocities well above supersonic speeds impact on the support member to form a metallurgical bond and deposit on the surface to form a seamless titanium shell, creating a monocoque structure over the support member. Melting is not involved in this process providing significant cost saving for implementation of protective atmosphere for titanium manufacturing. Rapid deposition of material is achievable due to extremely fast deposition of particles, which makes the process a cost effective and less labour intensive. In fact, the process has potential to be fully automated.

It will be appreciated that the present invention may be implemented in a variety of embodiments including those listed below. It will be appreciated that certain embodiments may be combined, whereas others are clearly mutually exclusive.

In a broadest embodiment the present invention provides a process for producing a titanium load-bearing structure, which comprises cold-gas dynamic spraying of titanium particles on to a suitably shaped support member.

A major advantage of the present invention is that it enables load-bearing structures to be produced that would otherwise necessitate welding of individual components together. As explained above, welding of titanium components has associated practical constraints.

Advantageously, the present invention provides a process for producing a titanium load-bearing structure that avoids the need to weld together individual components, which comprises cold-gas dynamic spraying of titanium particles on to a suitably shaped support member. In this embodiment the load-bearing structure is formed as a unitary construction rather than being assembled of individual components.

After formation of the load-bearing structure, it may be desirable to remove the support member. For example, this may be beneficial with respect to reducing the weight of the titanium structure. In this embodiment the present invention provides a process for producing a titanium load-bearing structure, which comprises cold-gas dynamic spraying of titanium particles on to a suitably shaped support member to produce the load-bearing structure followed by removal of the support member.

In another embodiment after formation of the load-bearing structure, the support member (or a portion of the support member) is retained. In this case the support member may be employed to impart beneficial properties to the structure or to a part of the structure, such as enhanced rigidity or strength. In this embodiment the final product of the process is a composite structure comprising titanium and the support member. Here the present invention provides a process for producing a titanium composite load-bearing structure, which comprises cold-gas dynamic spraying of titanium particles on to a suitably shaped support member. Aluminium or an aluminium alloy may be preferred as material for the support member.

The load-bearing structure may be of monocoque design. This may provide weight reduction and savings in materials consumption. In this embodiment the present invention provides a process for producing a titanium load-bearing structure of monocoque design, which comprises cold-gas dynamic spraying of titanium particles on to a suitably shaped support member.

The present invention may have particular utility in the manufacture of a bicycle or motorcycle frame. Accordingly, the present invention provides a process for producing a titanium bicycle or motorcycle frame, which comprises cold-gas dynamic spraying of titanium particles on to a suitably shaped support member. In this embodiment it may be preferred for at least part of the support member to be retained following cold-spraying thereby producing a composite structure. The support member may contribute to the final properties of the frame. Preferably, the support member is formed of aluminium or an aluminium alloy. When compared with conventional the manufacture of titanium bicycle and motorcycle frames, the invention provides advantages as follows:

Titanium frame is directly fabricated/from titanium powder. In conventional fabrication methods, titanium is manufactured through casting (under protective atmosphere) and a series of deformation processes to produce a profile. These titanium profiles are welded to final frame. Unlike current processes in this invention melting, profile fabrication and joining of titanium parts are not required. Such conventional steps tend to be labour intensive and time consuming.

Weight savings and corrosion resistance. The density of titanium (4.6 g/cm$^3$) is almost half that of steels (7.8 g/cm$^3$). This lower density provides improved weight savings. Superior corrosion resistance of titanium also eliminates any extra processing to provide for surface protection.

The process of the invention is a rapid and low cost process with capability of highly automated fabrication process.

Flexibility in fabrication of complicated shapes and thus great scope for design and development of new products.

Green process. This invention eliminates melting and joining processes in the manufacturing cycle thereby decreasing carbon footprint of the fabrication process. It also avoids the use of volatiles as used in polymer composite construction.

The present invention may find particular value in producing bicycle frames. Such frames tend to have a complex shape and are typically formed by welding of individual frame members together. The present invention therefore represents an attractive alternative manufacturing approach.

In the following process steps and practical considerations are discussed in the context of producing a bicycle frame using the process of the present invention. It will be appreciated however that these process steps and practical considerations will have relevance to the production of other types of load bearing structures.

The complex shape of a bicycle frame may require examination of nozzle configuration for successful deposition and development of a cold spray (direct) manufacturing system. In this regard an important manufacturing consideration is how the nozzle can be positioned and possibly moved so that complex angles of the frame can be formed.

Here it may be appropriate to employ a moveable (e.g. rotatable) stage to which the scaffold may be attached. Movement of the stage may be controlled using a programmable computer system. Cold spray operating parameters may also be varied in order to optimise deposition on the scaffold.

It may be appropriate to attach the cold spray nozzle to a robot arm that is moveable under computer control. However, in this case care must be taken to avoid or limit wear and tear in gas hose(s) and/or power cables attached associated with cold spray equipment as this may cause crack formation and attendant safety issues. In view of this, it may be preferable to keep the cold spray nozzle stationary and to move the scaffold relative to the nozzle. The scaffold may therefore be attached to a robot arm that is moveable under computer control.

Implementation of the invention may also involve design optimisation with respect to load bearing, weight and cost estimation of the final product. For example, Autodesk software may be used to develop CAD/CAM models to estimate stress distribution and deflection of the scaffold material. Following titanium deposition relevant mechanical properties of the product may be measured and/or modelled. From such work a template may be developed providing the capability to estimate product weight and load bearing capacity based on scaffold thickness and titanium deposit thickness.

An advanced robot system may be used to provide sophisticated movements necessary to achieve suitable cold spraying of a scaffold. The robot may use special software to demonstrate development and execution of the robot program in a virtual world. Transfer and execution of the developed program from virtual world to real deposition conditions may be applied to demonstrate a successful path that is extremely cost effective in relation to time required for direct manufacturing process, down time for the cold spray equipment, and personnel required. An example of a successful approach is given below.

Virtual Robot Program for Sub-Size Scaffold

A program was developed in virtual environment for a sub-sized scaffold that was designed using commercially available CAD software. In this regard, any 3D drawing software that can produce ".SAT" file should be acceptable. A sub-sized scaffold instead of full size scaffold was designed to achieve outcomes rapidly in respect of virtual programming.

Development of Advanced Algorithm

The sophisticated shape of a scaffold with many joins and angles required a sophisticated robot program with considerable number of (deposition) targets (>4000) and paths for successful deposition. Programming this large number of targets is extremely challenging and time consuming. To overcome this, an advanced algorithm may be developed within the software to considerably decrease the number of targets required for the developer to program. In this algorithm each part of the scaffold is considered as a module with 16 main targets that are programmed by the developer and extra targets are created by algorithm. This approach saves a considerable amount of time for programming. Overall, the targets within the algorithm have to satisfy the following conditions.

1. Being within the robot arm reach in relation to the cold spray nozzle exit.
2. Optimised for deposition of titanium (cold spray nozzle angle and distance).
3. No collision with cold spray nozzle or other objects in the vicinity of robot arm.

The final stage of the development of this type of direct manufacturing system is to examine the virtual robot program in real laboratory conditions. High precision robot movement may be tested by exposing a sub-size scaffold to a supersonic jet of cold sprayed titanium particles. Predicting supersonic jet behaviour may be challenging due to generation of complex turbulence from interaction of the jet with curved and angled surfaces of the scaffold. This requires execution of virtual program under real conditions.

Robot Parameters

For cost effective direct manufacturing in accordance with the invention the robot speed may be increased for faster production. It has been found however that the main effect of increased robot linear speed on deposition of titanium was a decrease in titanium deposit thickness. This thinning effect may be compensated by increasing the cold spray system feed rate (powder output). The robot linear speed does not have a significant effect on the efficacy of titanium deposition due to the extremely rapid particle velocity involved (>1000 m/s). This is almost 4 orders of magnitude faster than the typical robot speed. This presents a unique advantage for cold spray technology to achieve a consistent and rapid direct manufacturing process that eliminates production processes which involve time consuming welding and profile fabrication processes.

Improvement of Surface Quality

The surface quality/surface finish of the cold sprayed product may be important for marketing of the product. A variety of surface finishes may be achieved, including mirror finish, anodizing of different colour and other market driven reflective surfaces. A highly reflective surface may be achieved by suitable polishing of deposited titanium.

Virtual Robot Program for Full Size Scaffold

To achieve direct manufacturing for a full sized scaffold will involve:

1. Achievement of full robot arm reach for programmed targets; and
2. Prevention of near miss and collision of large scaffold with cold spray nozzle equipment and other objects in the vicinity during execution of the program.

The spray nozzle position may be optimised for a full size scaffold after positioning simulations to achieve the best robot arm reach for all scaffold components. A "home" position may be defined to bring the scaffold to its original position after execution of each program module. For rapid production a scaffold may be divided into parts, for example two halves such as a front and mirror half. Each part then has its own module for programming targets.

Further to this, a calibration module may be required to set up the nozzle in relation to the robot arm and scaffold in real deposition conditions. This is important in order to ensure that scaffold and nozzle are in precisely the same positions in space as simulated in the virtual program. A series of modules may be developed in the virtual program to deposit titanium on the whole scaffold structure. The key to success of the virtual programming is to achieve robot arm reach for all targets without any near miss and collisions for individual targets.

Successful Manufacturing of a Full Size Titanium Bicycle Frame

The first step for titanium deposition on a suitable scaffold involves calibration of the manufacturing system to achieve precise positions for scaffold and cold spray nozzle in space as per simulations in the robot virtual station. This is extremely important due to the fact that if nozzle and scaffold are out of alignment almost all of the programmed targets in virtual program would be out of position under real deposition conditions. This could lead to lack of deposition on certain areas and perhaps collisions of scaffold with nozzle. A calibration process may be devised to overcome these challenges.

Calibration of Scaffold in Respect to Cold Spray Nozzle

Accurate positioning of the scaffold in respect to the cold spray nozzle was important due to requirement for targets coordinates, in real deposition condition, to resemble robot virtual station. To achieve such accuracy scaffold had to be precisely positioned in respect to the robot arm and scaffold holder. A shaft may be designed to attach the scaffold to a robot arm with a pin to hold the scaffold in position. Desirably, the proposed calibration is fully automated, with the scaffold automatically adjusting its position with respect to the robot arm.

A calibration program may be developed to examine accurate positioning of the scaffold in respect to the nozzle tip. In this program angular calibration of the scaffold with respect to cold spray nozzle tip is possible. This calibration process for manufacturing is mainly developed for precise linear and angular positioning. This is particularly essential for future development of newly design scaffolds with potential for fully automated calibration system.

Deposition of Titanium

The next step after calibration of the manufacturing system and alignment of cold spray nozzle and scaffold is deposition of titanium. Execution of a developed robot program has led to successful production the first directly manufactured titanium bicycle frame by cold spraying of titanium powder. The following detail is given by way of illustration and should not be taken as limiting.

An aluminium scaffold, in the desired shape of a bicycle frame, was constructed by joining (welding) aluminium tubing with a wall thickness of 0.5 mm. On this scaffold was deposited an approximately 1 mm thick titanium layer in some 45 minutes. This time could be reduced by faster titanium feed rates and higher robot speeds. Notably, this compares with a production time of approximately 2 days using traditional welding processes.

The cold spray titanium deposit is in the form of a shell around the scaffold. This unique structure did not involve any joining and welding. This is believed to represent a paradigm shift in how such complicated structures are made.

The scaffold material may be removed leaving a titanium shell by dissolution of the scaffold in a suitable solution, such as caustic soda.

However, it is equally possible that the scaffold structure may be kept as part of the titanium bicycle frame to exploit uniquely combined properties of titanium and aluminium in a low density composite structure.

Titanium contributes a number of desirable properties including strength, lightness and durability. Such properties are very beneficial in a high performance bicycle. In accordance with this embodiment it may also be possible to produce bicycle frames for more "mainstream" usage. In such cases light weight can be achieved using a combination of an aluminium scaffold (density 2.6 g/cm$^3$) and a cold sprayed titanium outer shell/layer (density 4.6 g/cm$^3$). This should be compared to a typical steel having a density of about 7 g/cm$^3$. The cost of the frame may be controlled by varying the ratio of aluminium to titanium used. The resultant frame will still be less bulky than an all aluminium frame which must use mass to compensate for relatively low strength of aluminium (compared with the strength of titanium).

Embodiments of the present invention are illustrated with reference to the accompanying non-limiting example.

EXAMPLES

Example 1

Materials and Methods

Cold Spray System

A schematic of cold spray system that is may be used to deposit titanium powder on a suitably shaped scaffold is shown in FIG. 1.

KEY TO FIG. 1

1 Enclosure
2 Gas source (typically nitrogen, helium or a mixture of both)
3 Gas supplied at high pressure
4 Heater
5 Titanium powder feed
6 Electric heater
7 Laval nozzle
8 Supersonic jet of titanium particles
9 Scaffold
10 Robot Nitrogen, helium gas or a mixture of them under high pressure passes through a heating system and a converging/diverging nozzle. Rapid expansion of gas at the nozzle exit leads to acceleration of the gas to well above supersonic speeds and significant decrease in gas temperature. Injection of titanium powder into the cold spray gas stream results in acceleration of the particles to supersonic speed. This results in titanium particles to achieve the required kinetic energy for cold spray deposition and bonding with the scaffold.

Table 1 below shows the optimised parameters for successful deposition of cold spray titanium on an aluminium scaffold. It is worth noting that successful deposition can be achieved using range of operational parameters. This is because variation of temperature and pressure of the gas can each create conditions that lead to a critical velocity for deposition of titanium particles. Further, acceleration above this critical velocity contributes to densification of the titanium deposit and a change in mechanical properties of the coating produced.

Table 1 shows cold spray parameter ranges found to be useful for successful deposition of a grade 2 titanium powder on an aluminium scaffold in accordance with the present invention.

| Parameter number | Cold spray parameters | Range |
|---|---|---|
| 1 | Career Gas type | Nitrogen |
| 2 | Gas Pressure | 2.5-3.5 MPa |
| 3 | Gas Temperature | 450-850° C. |
| 4 | Powder Feed Rate | 1.5-10 kg/hour |
| 5 | Standoff Distance (Distance between nozzle exit and scaffold) | 25-40 mm |
| 6 | Powder Type | Titanium grade 2 irregular shape |
| 7 | Titanium Particle Size Range | 5-40 microns |

Robot

A robot is used to manipulate the scaffold in front of the cold spray nozzle. Movement of the scaffold is controlled very accurately by a computer-controlled robot arm which is programmed to follow a programmed path at a defined speed.

Scaffold

The scaffold is a thin structure (0.5 mm or greater in thickness) on which titanium can be deposited. In this way titanium forms a seamless shell over the scaffold. In this invention aluminium is preferably used as scaffold material due to its light weight, density (2.7 g/cm$^3$) and affordable price. However, in principle, any material that titanium can be deposited using cold spray could be used for the scaffold.

Example 2

As noted above, the present invention is believed to have particular utility in the manufacture of bicycle frames. This example details the steps and processes involved in making such a frame. It is to be appreciated however that the steps and processes described may be applied to produce other products in accordance with the present invention.

Optimisation of Deposition Process

To optimise titanium deposition process, a series of experiments were designed to determine the critical cold spray parameters. Titanium particles were applied by cold spraying to an unalloyed aluminium (1100 type) scaffold to produce a titanium bicycle frame structure.

The deposition was made on particularly designed tube shape samples with a dome shape at one end. The dome shape allowed for examination of deposition on curved surfaces. Some of the scaffold pieces were also machined in half to examine the effect of split line on titanium deposition. Experimentation on split specimens is believed to be particularly important for future development of monocoque type structures.

Results showed successful deposition on the edge, with dome shape, and middle sections of the specimens. Investigation of the cold spray nozzle angle showed that a 45° jet angle, perpendicular to the specimen axis, improved the filling effect of the deposit for the samples with split line. A similar improvement in titanium deposit filling the split line was observed when the sample was rotated at 200 rpm with jet angle at 45°.

Table 2 below shows cold spray parameters that were determined for deposition on this type of substrate.

| | | |
|---|---|---|
| 1 | Cold spray nozzle type | Nozzle type 27 TC, CGTA00027 (Short Nozzle) |
| 2 | Cold spray gas temperature | 680° C. |
| 3 | Cold spray gas pressure | 28 bar |
| 4 | Powder feed rate | 2 RPM on the powder feeder disk |
| 5 | *Powder feeder carrier gas | 5 m$^3$/hr |
| 6 | Deposition gas | Nitrogen |
| 7 | Standoff (Distance from nozzle exit and scaffold) | 30-45 mm |

Characterisation of Deposited Titanium

Figure 2:
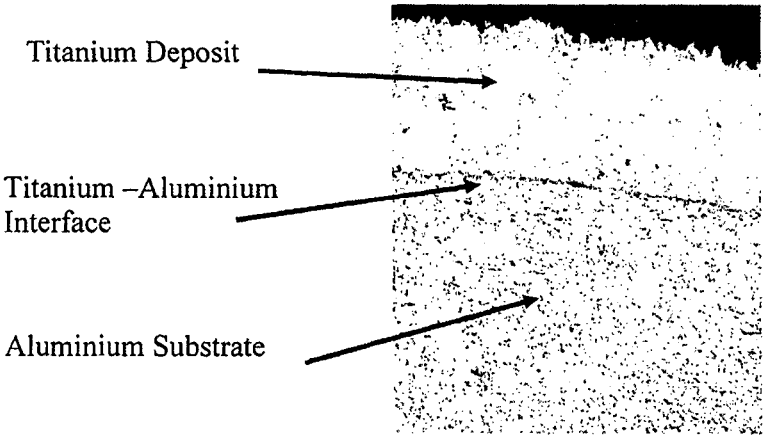
FIG. 2 is a micrograph of cold sprayed titanium on an aluminium support member (etched)

To determine the bonding between deposited titanium and the underlying aluminium scaffold, optical and scanning electron microscopy were used. Optical microscopy observations showed successful bond formation between titanium and aluminium without the presence of any delimitation or cracks (see FIG. 2).

Figure 3:
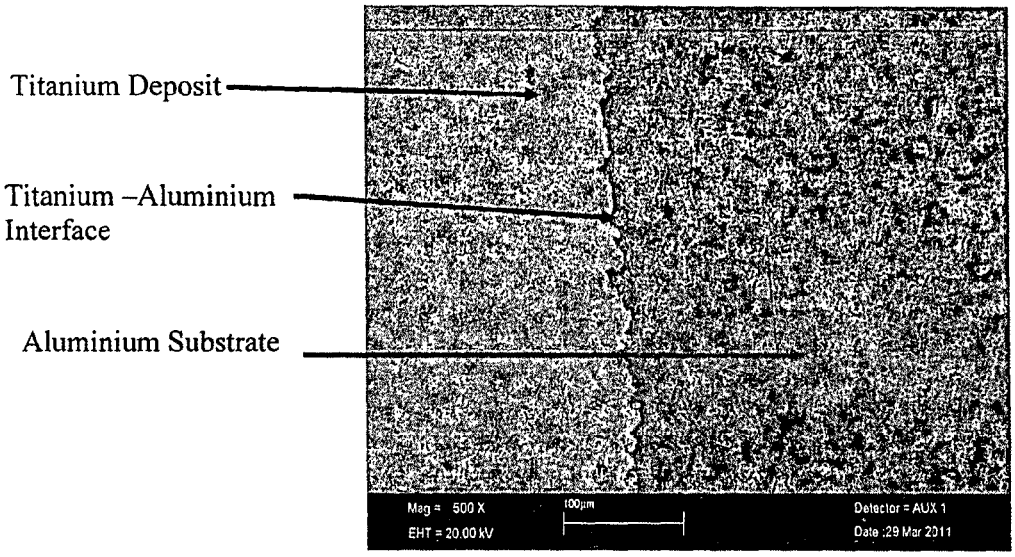
FIG. 3 is a scanning electron micrograph of the interface between titanium and aluminium.

Scanning electron microscopy of the interface between cold spray deposited titanium and aluminium revealed successful interlocking between titanium deposit and substrate which is due to supersonic impact of titanium particles penetrating aluminium surface and forming a strong bond with aluminium substrate (see FIG. 3).

The claims defining the invention are as follows:

1. A process for producing a titanium load-bearing structure that could otherwise be produced by welding together individual titanium components, which process comprises cold-gas dynamic spraying of titanium particles on to a support member to form the load-bearing structure as a unitary construction, wherein the shape and configuration of the support member reflects the intended shape and configuration of the load-bearing structure to be produced, and wherein the support member is at least partially removed.

2. The process of claim 1, wherein after cold-gas dynamic spraying has been completed the support member is removed to produce a free-standing titanium load-bearing structure.

3. The process of claim 2, wherein the support member is removed by mechanical means or by being dissolved or melted.

4. The process of claim 2, wherein the support member is removed by relying on differences in thermal expansion coefficients between the titanium and support member.

5. The process of claim 1, wherein after cold-gas dynamic spraying has been completed the support member is retained at specific locations and removed from other locations of the load-bearing structure.

6. The process of claim 5, wherein the support member is retained in regions of the load-bearing structure that in use will experience higher load and removed from regions of the load-bearing structure that in use will experience lower load.

7. The process of claim 1, wherein the titanium that is applied by cold-gas dynamic spraying is of a composition that is varied as cold-gas dynamic spraying proceeds in order to meet location specific load-bearing requirements in the load-bearing structure.

8. The process of claim 1, wherein the titanium is deposited on the support member with varying thickness based location specific load requirements of the load-bearing structure.

9. The process of claim 1, wherein the titanium particles have a particle size of from 5 to 40 microns with an average particle size of about 25 microns.

10. The process of claim 1, wherein the titanium is selected from commercial purity titanium or an alloy of titanium, aluminium and vanadium.

11. The process of claim 1, wherein the support member is moved relative to a cold-gas dynamic spray nozzle that is used for the cold-gas dynamic spraying.

12. The process of claim 1, wherein the load-bearing structure is a frame.

13. The process of claim 12, wherein the frame is a frame for an aerospace vessel, nautical vessel or motor vehicle, or a frame for a bicycle, motorcycle, motor scooter, wheelchair, hang glider or luggage.

14. The process of claim 13, wherein the frame is a bicycle frame.

15. The process of claim 14, wherein the support member is formed of aluminium or an aluminium alloy and at least part of the support member is retained following cold-gas dynamic spraying thereby producing a composite load-bearing structure.

* * * * *